US010072471B2

(12) United States Patent
Uhlenberg et al.

(10) Patent No.: US 10,072,471 B2
(45) Date of Patent: Sep. 11, 2018

(54) SPONGE LINER SLEEVES FOR A CORE BARREL ASSEMBLY, SPONGE LINERS AND RELATED METHODS

(71) Applicant: Baker Hughes Incorporated, Houston, TX (US)

(72) Inventors: Thomas Uhlenberg, Niedersachsen (DE); Marcel Brand, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 239 days.

(21) Appl. No.: 15/050,186

(22) Filed: Feb. 22, 2016

(65) Prior Publication Data

US 2016/0245030 A1 Aug. 25, 2016

Related U.S. Application Data

(60) Provisional application No. 62/120,707, filed on Feb. 25, 2015.

(51) Int. Cl.
*E21B 25/06* (2006.01)

(52) U.S. Cl.
CPC ..... *E21B 25/06* (2013.01)

(58) Field of Classification Search
CPC ..... E21B 10/02; E21B 25/06
See application file for complete search history.

(56) References Cited

U.S. PATENT DOCUMENTS 1,857,693 A 5/1932 Quintrell
1,867,720 A 7/1932 Wellwnsiek
(Continued)

FOREIGN PATENT DOCUMENTS

GB 1100962 A * 1/1968 ..... E21B 25/02
GB 2000824 A 1/1979
WO 9726439 A1 7/1997

OTHER PUBLICATIONS

International Search Report for International Application No. PCT/US2016/019581 dated Jun. 29, 2016, 3 pages.
(Continued)

*Primary Examiner* — Jennifer H Gay
(74) *Attorney, Agent, or Firm* — TraskBritt

(57) ABSTRACT

A liner tube for a core barrel assembly includes a substantially cylindrical sleeve having an inner surface configured to be coupled to a layer of material that is configured to absorb or adsorb formation fluids or parts of formation fluids. At every longitudinal location of the sleeve with respect to a longitudinal axis of the sleeve, a transverse cross-section of a wall of the sleeve may include at least one gap extending radially through the entire wall of the sleeve, such that the at least one gap separates a portion of the sleeve wall on one circumferential side of the at least one gap from another portion of the sleeve wall on an opposite circumferential side of the at least one gap. The sleeve has flexibility in a circumferential direction greater than that of a sleeve without a gap extending radially through an entire wall of the sleeve at a transverse cross-section of the sleeve at every longitudinal location of the sleeve. The sleeve may include at least two circumferential segments in contact with an elastic element extending in a circumferential direction. Methods of forming a liner for a core barrel assembly, methods of building a coring tool with such a liner, and methods of coring a formation material are also disclosed.

18 Claims, 8 Drawing Sheets

(56) References Cited

U.S. PATENT DOCUMENTS

| | | | | |
|---|---|---|---|---|
| 2,019,176 | A | 10/1935 | Dodds | |
| 2,596,832 | A | 5/1952 | Williams, Jr. | |
| 2,747,841 | A | 5/1956 | Adamson et al. | |
| 2,789,790 | A | 4/1957 | Kirby, II | |
| 2,876,996 | A * | 3/1959 | Hildebrandt | E21B 25/06 175/255 |
| 3,012,622 | A | 12/1961 | Benjamin | |
| 3,511,324 | A | 5/1970 | Pieters et al. | |
| 3,804,184 | A | 4/1974 | Gusman et al. | |
| 3,986,555 | A | 10/1976 | Robertson | |
| 4,142,594 | A | 3/1979 | Thompson et al. | |
| 4,230,192 | A | 10/1980 | Pfannkuche | |
| 4,256,192 | A | 3/1981 | Aumann | |
| 4,312,414 | A * | 1/1982 | Park | E21B 25/06 175/249 |
| 4,449,594 | A | 5/1984 | Sparks | |
| 4,479,557 | A | 10/1984 | Park et al. | |
| 4,502,553 | A * | 3/1985 | Park | E21B 25/06 166/228 |
| 4,552,229 | A | 11/1985 | Radford et al. | |
| 4,553,613 | A | 11/1985 | Radford | |
| 4,566,545 | A | 1/1986 | Story et al. | |
| 4,580,643 | A | 4/1986 | Fox et al. | |
| 4,598,777 | A | 7/1986 | Park et al. | |
| 4,638,872 | A | 1/1987 | Park et al. | |
| 4,664,205 | A | 5/1987 | Knighton et al. | |
| 4,716,974 | A | 1/1988 | Radford et al. | |
| 4,735,269 | A | 4/1988 | Park et al. | |
| 4,787,983 | A | 11/1988 | DiFoggio et al. | |
| 4,930,587 | A | 6/1990 | Young et al. | |
| 5,042,598 | A | 8/1991 | Sherman | |
| 5,107,942 | A | 4/1992 | Radford | |
| 5,253,720 | A | 10/1993 | Radford et al. | |
| 5,255,751 | A | 10/1993 | Stogner | |
| 5,360,074 | A | 11/1994 | Collee et al. | |
| 5,439,065 | A | 8/1995 | Georgi | |
| 5,482,123 | A | 1/1996 | Collee | |
| 5,546,798 | A | 8/1996 | Collee et al. | |
| 5,560,438 | A | 10/1996 | Collee et al. | |
| 5,568,838 | A | 10/1996 | Struthers et al. | |
| 5,881,825 | A | 3/1999 | Collee et al. | |
| 6,009,960 | A | 1/2000 | Leitko, Jr. et al. | |
| 6,158,534 | A | 12/2000 | Fanuel | |
| 6,164,389 | A | 12/2000 | Fanuel et al. | |
| 6,216,804 | B1 | 4/2001 | Aumann et al. | |
| 6,230,825 | B1 | 5/2001 | Aumann et al. | |
| 6,305,482 | B1 | 10/2001 | Aumann et al. | |
| 6,378,631 | B1 | 4/2002 | Aumann et al. | |
| 6,719,070 | B1 * | 4/2004 | Puymbroeck | E21B 25/06 175/20 |
| 7,234,547 | B2 | 6/2007 | Puymbroeck et al. | |
| 8,453,766 | B2 | 6/2013 | Graterol et al. | |
| 8,689,903 | B2 | 4/2014 | Beuershausen et al. | |
| 2002/0033281 | A1 | 3/2002 | Aumann et al. | |
| 2002/0139583 | A1 | 10/2002 | Masui et al. | |
| 2006/0037780 | A1 | 2/2006 | Zastresek | |
| 2011/0253452 | A1 | 10/2011 | Beuershausen et al. | |
| 2012/0152521 | A1 * | 6/2012 | Akkerman | E21B 17/06 166/85.1 |
| 2012/0261192 | A1 | 10/2012 | Mageren | |
| 2013/0081878 | A1 * | 4/2013 | Wilson | E21B 25/06 175/58 |
| 2015/0021096 | A1 | 1/2015 | Wesemeier et al. | |
| 2015/0021097 | A1 | 1/2015 | Wesemeier et al. | |
| 2015/0060142 | A1 | 3/2015 | Uhlenberg | |
| 2015/0068812 | A1 | 3/2015 | Wesemeier et al. | |
| 2015/0275604 | A1 * | 10/2015 | Norrie | E21B 25/10 175/58 |
| 2016/0245030 | A1 * | 8/2016 | Uhlenberg | E21B 25/06 |
| 2016/0258223 | A1 * | 9/2016 | Uhlenberg | E21B 10/605 |

OTHER PUBLICATIONS

International Written Opinion for International Application No. PCT/US2016/019581 dated Jun. 29, 2016, 16 pages.

Sponge Coring, DBS Coring Services (1993), 22 pages.

* cited by examiner

SPONGE LINER SLEEVES FOR A CORE BARREL ASSEMBLY, SPONGE LINERS AND RELATED METHODS

CROSS-REFERENCE TO RELATED APPLICATION

This application claims the benefit of U.S. Provisional Patent Application Ser. No. 62/120,707, filed Feb. 25, 2015, the disclosure of which is hereby incorporated herein in its entirety by this reference.

TECHNICAL FIELD

The present disclosure relates generally to apparatuses and methods for taking core samples of subterranean formations. More specifically, the present disclosure relates to a sponge liner sleeve having slots formed therein for providing the sponge liner with a degree of elasticity to provide compliance in the circumferential direction.

BACKGROUND

Formation coring is a well-known process in the oil and gas industry. In conventional coring operations, a core barrel assembly is used to cut a cylindrical core from the subterranean formation and to transport the core to the surface for analysis. Analysis of the core can reveal valuable data concerning subsurface geological formations—including parameters such as permeability, porosity, and fluid saturation—that are useful in the exploration for and production of petroleum, natural gas, and minerals. Such data may also be useful for construction site evaluation and in quarrying operations.

As shown in FIG. 1, a conventional core barrel assembly 2 may include an outer barrel 4 having, at a bottom end, a core bit 6 adapted to cut the cylindrical core and to receive the core in a central opening, or throat 8. The opposing end of the outer barrel is attached to the end of a drill string, which conventionally comprises a plurality of tubular sections that extends to the surface. Located within, and releasably attached to, the outer barrel is an inner barrel assembly having an inner tube configured to receive the core as the core traverses the throat of the core bit and to retain the core for subsequent transportation to the surface.

One conventional approach to preserving the integrity of the core and obtaining reliable formation data, especially reservoir fluid properties such as oil and water saturation, is coring with a fluid retaining functionality, for example, sponge coring. Sponge coring is performed using a "sponge core barrel." Generally, a sponge core barrel comprises a conventional core barrel assembly, as described above, that has been adapted for use with one or more sponge liners 10. Each sponge liner includes a layer of material selected for its ability to absorb or adsorb the reservoir fluid of interest (for example, oil) from a core sample. Similar to the sponge material approach, there are other ways to construct a material to absorb or adsorb formation fluids of interest. In the context of the present disclosure, the term "sponge" refers to any material that is suitable to absorb or adsorb fluids escaping the formation sample material. As non-limiting examples, this could be material with a porous foam like structure, a felt like structure, a fur like structure, a fabric structure or woven structures, in individual or a multitude of layers, or any combination of the foregoing structures. Also, the terms "absorb" and "adsorb" are used synonymously in this application to describe the capability of keeping formation fluids in a certain location immobilized to a certain degree, even though the technical meanings of these terms are different.

As shown in FIG. 2, a conventional sponge liner comprises an annular sponge layer 12 encased in a tubular sleeve 14. The annular sponge layer 12 is constructed of a material adapted to absorb a specified reservoir fluid of interest. For example, if the particular formation characteristic of interest is oil saturation, the sponge layer 12 may be constructed of an oil-absorptive material such as, by way of non-limiting example, a polyurethane foam. To obtain formation water saturation data, a water-absorptive material is used to construct the sponge layer 12. The tubular sleeve 14 provides structural support for the annular sponge layer 12 and is typically constructed of a relatively rigid material such as, as a non-limiting example, metal. The annular sponge layer 12 is adhered to an interior cylindrical surface 16 of the sleeve 14. Because the sponge layer 12 contacts the core and is relatively flexible as compared to the core, the sponge liners serve to contain the core and protect the core from mechanical damage. Sponge liners are typically supplied in sections, a number of which are placed end-to-end within the inner tube to substantially fill the length (usually a standard 30 feet, although shorter or longer lengths are possible) of the inner tube. The tubular sleeve 14 of a conventional sponge liner typically comprises an aluminum material.

The inner barrel assembly of a sponge core barrel includes an inner tube adapted to receive the plurality of sponge liners 10. During a coring operation, a core shoe disposed at the lower end of the inner tube guides a core 18 being cut into the inner tube and sponge liners 10 disposed therein, where the core is retained for subsequent transportation to the surface and later analysis. A substantially cylindrical interior cavity 20 of the annular sponge layer is of a diameter substantially equal to the diameter of the core being cut, such that an interior cylindrical surface 22 of the annular sponge layer substantially continuously contacts the exterior surface 24 of the core 18 or is in immediate proximity to it, so that any fluid of interest exiting the core 18 will be absorbed by the sponge layer 12 and will not flow off and disperse into the drilling fluid system of the core barrel assembly. The substantially continuous contact between the annular sponge layer 12 and the core 18 often results in the application of significant sliding frictional forces F on the core 18 as the core 18 moves through the core barrel, which frictional forces can, in some instances, overcome the compressive strength of the formation material, causing the core 18 to compact, fracture, jam, or otherwise become damaged. The significant frictional forces between the core 18 and annular sponge layer 12 can also exceed the available weight-on-bit (WOB) applicable to the drill string to which the core barrel assembly is secured, causing the rate-of-penetration (ROP) of the core bit to drop significantly.

When the inner barrel assembly and core 18 are raised to the surface, where the ambient pressure may be significantly less than the downhole pressure, formation gases within the core sample may expand and expel reservoir fluids from the core 18. The expelled reservoir fluids are then absorbed by the annular sponge layer 12 and preserved for later analysis, rather than separating from the core sample and flowing out, as by gravity, from the inner tube. Perforations in the sleeve 14 of the sponge liner allow reservoir gases to escape.

BRIEF SUMMARY

This summary is provided to introduce a selection of concepts in a simplified form. These concepts are described in further detail in the detailed description of embodiments of the disclosure below. This summary is not intended to identify key features or essential features of the claimed subject matter, nor is it intended to be used to limit the scope of the claimed subject matter.

In some embodiments, a liner for a core barrel assembly includes a sleeve having an inner surface configured to be coupled to a layer of material configured to absorb or adsorb formation fluids or parts of formation fluids. At every longitudinal location of the sleeve, a transverse cross-section of a wall of the sleeve includes at least one gap extending radially through the entire wall of the sleeve. The sleeve has a flexibility in a circumferential direction greater than that of a sleeve without a gap extending radially through a wall of the sleeve at a transverse cross-section of the sleeve at every longitudinal location of the sleeve.

In additional embodiments, a liner for a core barrel assembly includes a sleeve having at least two circumferential segments each having an inner surface coupled to a layer of material. The layer of material is configured to absorb or adsorb formation fluids or portions thereof. The at least two circumferential segments of the sleeve may be separated from one another by slots formed through a wall of the sleeve. The liner may include an elastic element in contact with the at least two circumferential segments of the sleeve, and the elastic element may extend in a circumferential direction.

In yet additional embodiments, a liner for a core barrel assembly includes at least two separate liner segments together extending substantially completely around a circumference of the liner. At least one of the at least two separate liner segments is coupled to an associated layer of material. The associated layer of material is configured to absorb or adsorb formation fluids or portions thereof. The liner further includes at least one elastic element located on an outer surface of the at least two separate liner segments. The at least one elastic element is configured to act as a spring member.

In further embodiments, a method of forming a liner for a core barrel assembly includes providing a sleeve having an inner surface configured to be coupled to a layer of material that is configured to absorb or adsorb formation fluids or parts of formation fluids. At every longitudinal location of the sleeve, a transverse cross-section of a wall of the sleeve may include at least one gap extending radially through the entire wall of the sleeve. The sleeve has a flexibility in a circumferential direction greater than that of a sleeve without a gap extending radially through a wall of the sleeve at a transverse cross-section of the sleeve at every longitudinal location of the sleeve.

In further additional embodiments, a method of building a coring tool having a liner for a core barrel assembly includes locating a sleeve in a core barrel assembly. The sleeve has an inner surface configured to be coupled to a layer of material that is configured to absorb or adsorb formation fluids or parts of formation fluids. At every longitudinal location of the sleeve, a transverse cross-section of a wall of the sleeve may include at least one gap extending radially through the entire wall of the sleeve. The sleeve has a flexibility in a circumferential direction greater than that of a sleeve without a gap extending radially through a wall of the sleeve at a transverse cross-section of the sleeve at every longitudinal location of the sleeve.

In yet further additional embodiments, a method of coring a formation of subterranean earth material includes engaging a formation of subterranean earth material with a coring tool. The coring tool includes a core barrel assembly having at least one liner disposed therein. The at least one liner includes an annular layer of material coupled to an inner surface of a sleeve. The annular layer of material is configured to absorb or adsorb formation fluids or parts of formation fluids. The method includes modifying the circumferential flexibility of the at least one liner prior to a coring operation or during the course of a coring operation. Modifying the flexibility of the at least one liner comprises one or more of: adding or removing one or more spring members extending at least partially about a circumference of the sleeve; breaking one or more material links of a wall of the sleeve between adjacent slots formed in the wall of the sleeve; and generating at least one slot into the sleeve, wherein the at least one slot extends radially through a wall of the sleeve, and at least a portion of the at least one slot extends longitudinally along at least a portion of a length of the sleeve.

In yet still further additional embodiments, a method of coring a formation of subterranean earth material includes engaging a formation of subterranean earth material with a coring tool. The coring tool includes a core barrel assembly having at least one liner disposed therein. The at least one liner includes an annular layer of material coupled to an inner surface of a sleeve. The method includes expanding the sleeve radially as a core sample extends within the liner.

In other embodiments, a liner for a core barrel assembly includes a sleeve having an inner surface configured to be coupled to a layer of sponge material, the sleeve having at least one slot formed in an outer surface thereof. The at least one slot extends radially through a wall of the sleeve from an outer surface of the sleeve to the inner surface of the sleeve. At least a portion of the at least one slot extends longitudinally continuously or discontinuously along the sleeve.

In other embodiments, a liner for a core barrel assembly includes a sleeve having at least one slot formed in an outer surface thereof. The at least one slot extends radially through a wall of the sleeve. At least a portion of the at least one slot extends longitudinally along the sleeve, and the at least one slot is configured to provide the sleeve with a degree of elasticity in a radial direction from a longitudinal axis of the sleeve. The liner further includes an annular layer of sponge material coupled to an inner surface of the sleeve.

In other embodiments, a method of forming a liner for a core barrel assembly includes providing a sleeve and forming at least one slot in an outer surface of the sleeve. The at least one slot extends radially through a wall of the sleeve. At least a portion of the at least one slot extends longitudinally along the sleeve. The at least one slot is configured to provide the sleeve with a degree of elasticity in a radial direction from a longitudinal axis of the sleeve. The method further includes affixing an annular layer of sponge material to an inner surface of the sleeve.

In other embodiments, a sponge liner tube for a core barrel assembly includes a sleeve having an adjustable elasticity in the radial direction.

In other embodiments, a method of coring a formation of subterranean earth material comprises engaging a formation of subterranean earth material with a coring tool that includes a core barrel assembly having at least one sponge liner disposed therein. The at least one sponge liner includes an annular layer of sponge material coupled to an inner surface of a sleeve. The method includes expanding the sleeve radially as a core sample extends within the sponge liner.

DETAILED DESCRIPTION

The illustrations presented herein are not meant to be actual views of any sponge core barrel, sponge liner, sleeve, or component thereof, but are merely idealized representations that are used to describe embodiments of the disclosure.

As used herein, directional terms, such as "above," "below," "up," "down," "upward," "downward," "top," "bottom," "top-most," "bottom-most," "proximal," and "distal" are to be interpreted from a reference point of the object so described as such object is located in a vertical well bore, regardless of the actual orientation of the object so described. For example, the terms "above," "up," "upward," "top," "top-most," and "proximal" are synonymous with the term "uphole," as such term is understood in the art of subterranean well bore drilling. Similarly, the terms "below," "down," "downward," "bottom," "bottom-most," and "distal" are synonymous with the term "downhole," as such term is understood in the art of subterranean well bore drilling and coring operations.

As used herein, the term "longitudinal" refers to a direction parallel to a longitudinal axis of the sponge liner. For example, a "longitudinal" cross-section shall mean a "cross-section viewed in a plane extending along the longitudinal axis of the sponge liner."

As used herein, the terms "lateral," "laterally," "transverse," or "transversely" shall mean "transverse to a longitudinal axis of the sponge liner." For example, a "lateral" or "transverse" cross-section shall mean a "cross-section viewed in a plane transverse to the longitudinal axis of the sponge liner."

Figure 1:
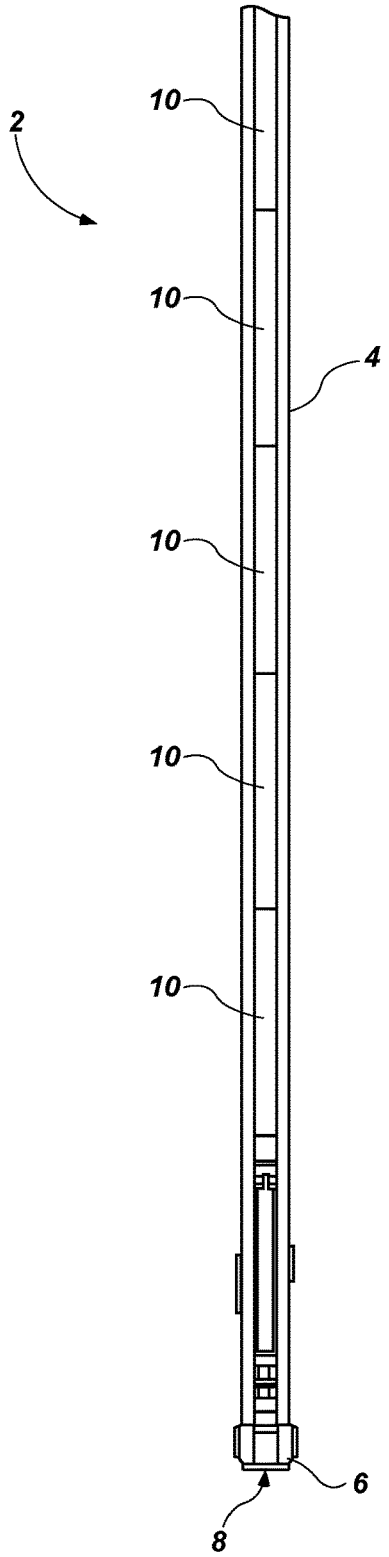
FIG. 1 (Prior Art)
FIG. 1 illustrates a partial cross-sectional view of a prior art core barrel assembly.
Figure 2:
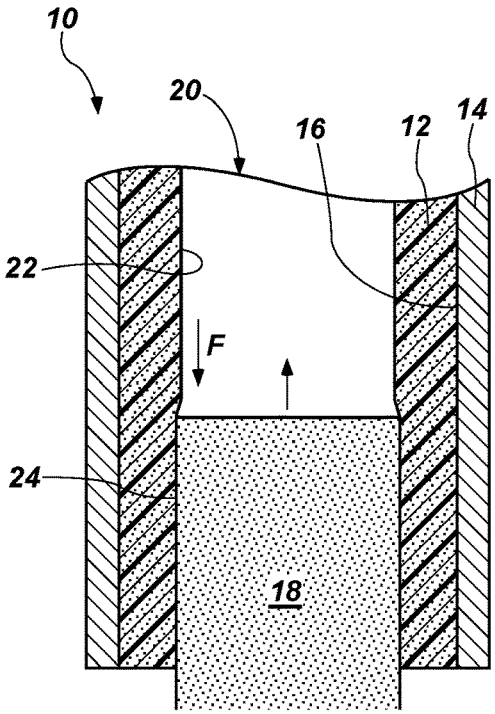
FIG. 2 (Prior Art)
FIG. 2 illustrates a partial cross-sectional view of a prior art sponge liner with a core sample extending therein.
Figure 3A:
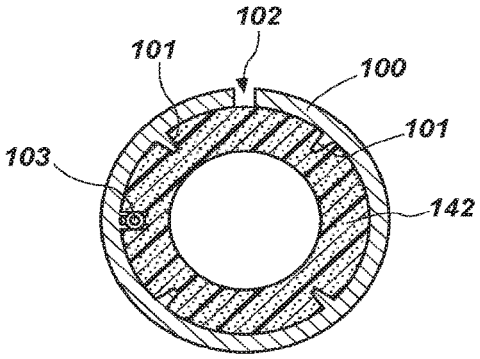
FIG. 3A illustrates a transverse cross-sectional view of a sponge liner, according to an embodiment of the present disclosure.
Figure 3C:
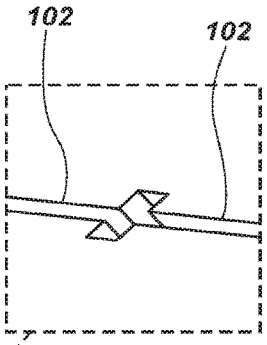
FIG. 3C illustrates a magnified perspective view of a slot, similar to the slot shown in FIG. 3B, wherein a tab associated with the slot has been fractured or removed.
Figure 3:
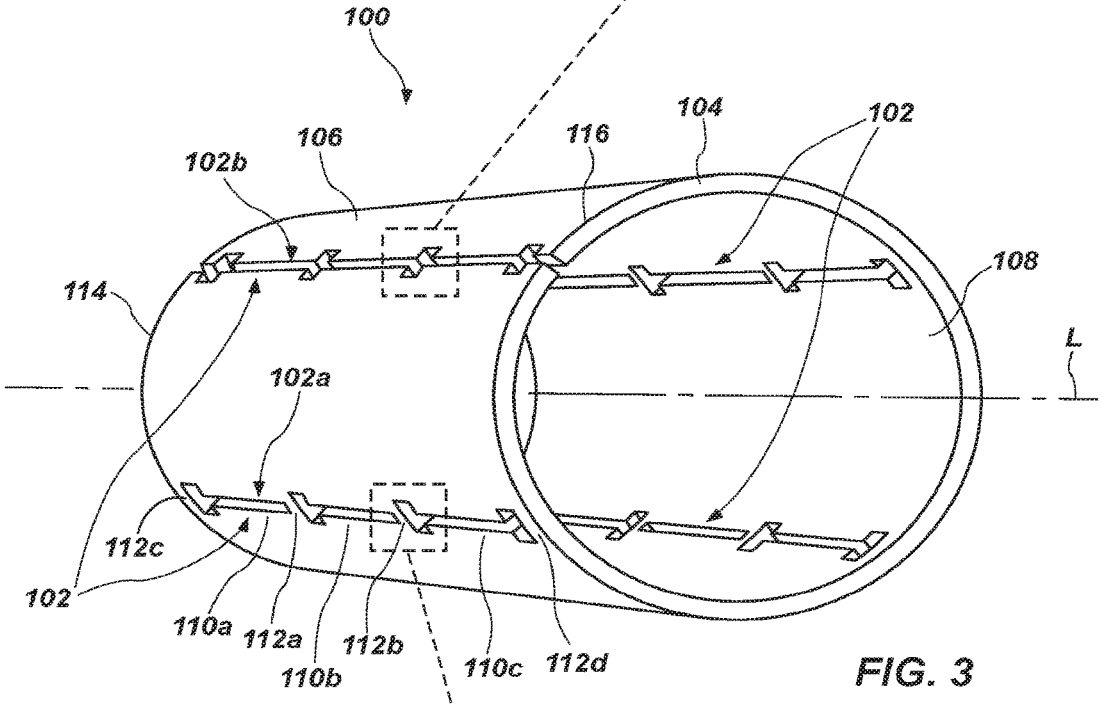
FIG. 3 illustrates a perspective view of a tubular sleeve of a sponge liner, according to an embodiment of the present disclosure.

FIG. 3 illustrates a tubular sleeve 100, or "sponge liner tube" or "shell," of a sponge liner according to an embodiment of the present disclosure. The tubular sleeve may comprise aluminum or one or more other materials, such as other metals, alloys, or a polymer composite. The tubular sleeve 100 may be of substantially cylindrical shape. Additionally, as shown in FIG. 3A, the tubular sleeve 100 may have internal ribs or protrusions 101, directed either substantially parallel to or slanted or spiraling with respect to the longitudinal axis L of the sleeve 100. In some embodiments, stub-like protrusions 103 may be located on an interior of the sleeve 100. The tubular sleeve 100 may include a plurality of slots 102 extending radially through a wall 104 of the tubular sleeve 100 from an outer surface 106 of the sleeve 100 to an inner surface 108 of the sleeve 100. The slots 102 provide the tubular sleeve 100 with increased elasticity in a circumferential direction with respect to a longitudinal axis of the sleeve 100, allowing an annular sponge layer attached to the inner surface 108 of the sleeve 100 (shown in FIGS. 5 and 6) to maintain contact with a core entering the sleeve 100 while reducing frictional forces between the sponge layer and the core as the core enters the sponge liner. The sponge layer may include any absorptive material known in the art. By way of non-limiting example, the sponge layer may include a polyurethane foam, a felt, a fur, a fabric, a woven structure, or any combination of the foregoing. The slots 102 may be evenly spaced apart about a circumference of the sleeve 100. For example, as shown in FIG. 3, the sleeve 100 may include four (4) slots 102, each of which may be spaced apart from the nearest slot 102 by about 90 degrees about the circumference of the sleeve 100. However, in other embodiments, the slots 102 may be unevenly spaced apart about the circumference of the sleeve 100.

The slots 102 may be formed by a wide variety of processes, including, by way of non-limiting example, cutting, milling, or other methods. Alternatively, the sleeve 100 may be formed to include the slots 102 from the outset by a casting process, such as centrifugal casting, or other methods.

Moreover, while four (4) slots 102 are shown extending through the wall 104 of the tubular sleeve 100 of FIG. 3, it is to be appreciated that fewer or more than four (4) slots may be formed in the wall 104 of the sleeve 100. For example, the sleeve 100 may include as few as one (1) slot 102 formed through the wall 104 thereof. In other embodiments, the sleeve 100 may include six (6) slots 102 formed through the wall 104 thereof. In such an embodiment, the six (6) slots may be spaced apart at about 60 degree intervals about a circumference of the sleeve 100. However, as previously described, the six (6) slots may be spaced apart at uneven intervals about a circumference of the sleeve. In further embodiments, the sleeve 100 may include eight (8) or more slots 102 formed through the wall 104 thereof. The present disclosure does not contemplate an upper limit to the amount of slots 102 formed through the wall 104 of the tubular sleeve 100.

Additionally, while the slots 102 are shown as extending longitudinally along the sleeve 100, in some embodiments the slots 102 may also include portions oriented and extending substantially radially along the circumference of the sleeve 100. In further embodiments, the slots 102 may have longitudinally extending portions or segments, radially extending portions or segments, obliquely extending portions or segments, or irregularly oriented portions or segments. It is to be understood that any pattern or orientation of the slots 102 is within the scope of the present disclosure.

Figure 3B:
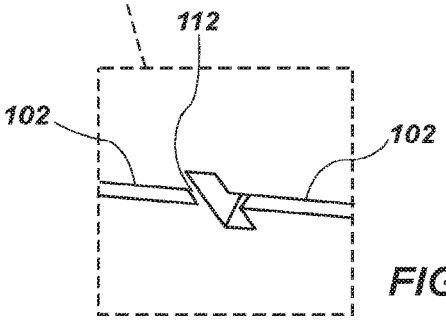
FIG. 3B illustrates a magnified perspective view of a slot extending through the tubular sleeve of FIG. 3, wherein a tab associated with the slot is unfractured.

Each of the slots 102 may include a plurality of slot segments 110 separated by distinct material links, which are referred to as "tabs" 112 in relation to the embodiment of FIG. 3, of the material of the sleeve 100. For example, slot 102*a* of FIG. 3 includes three (3) slot segments 110*a*, 110*b*, 110*c* separated by two (2) tabs 112*a*, 112*b*. A longitudinally uppermost end of slot 102*a* may be separated from an upper end 114 of the sleeve 100 by a tab 112*c*, while a longitudinally bottom end of slot 102*a* may be separated from a bottom end 116 of the sleeve 110 by a tab 112*d*. FIG. 3B illustrates a magnified view of a tab 112 separating two segments of a slot 102. It is to be appreciated that the tab 112 may be configured as any portion of the sleeve wall 104 located between one segment of a slot 102 and an adjacent segment of the same or a different slot 102 or between a segment of the slot 102 and an adjacent upper end 114 or lower end 116 of the sleeve 100. The tabs 112 may have various shapes and configurations, and are not limited to the design illustrated in FIGS. 3 and 3B, as will be discussed in more detail below. The combination of the slots 102 and the tabs 112 enables the sleeve 100 to exhibit a higher elasticity, particularly in the circumferential direction (which also provides a higher degree of elasticity in the radial direction), while also maintaining the sleeve 100 as a single, integral body. The slots 102 and tabs 112 may optionally be located and oriented such that, at each longitudinal location of the sleeve 100, the sleeve wall 104 does not extend continuously about the entire circumference of the sleeve 100.

With continued reference to FIG. 3, if greater flexibility of the sleeve 100 is required, one or more of the tabs 112 interposed between segments of a slot 102 may be fractured to join segments of the slot 102. Slot 102*b* of FIG. 3 is shown having each of the tabs 112 of the wall 104 fractured or otherwise removed, allowing the slot 102*b* to extend continuously from the upper end 114 of the sleeve 100 to the lower end 116 of the sleeve 100, thus increasing the radial flexibility of the sleeve 100 and, correspondingly, the radial flexibility of a sponge layer attached to the inner surface of the sleeve 100. For illustrative purposes, FIG. 3 shows slot 102*a* with all the tabs 112 in place and slot 102*b* with all of the tabs 112 removed or fractured, it is to be understood that this is for illustrative purposes. In practice, a user may fracture or remove selected tabs 112 from any of the slots 102 in any desired pattern to provide the sleeve 100 with a desired degree of radial elasticity. For example, a user may fracture or remove the tabs 112 of the slots 102 in a manner to provide the sleeve 100 with a uniform degree of increased elasticity in the radial direction. FIG. 3C shows a magnified view of a slot 102 with a tab removed between adjacent slot segments. The tabs 112 may be removed by fracturing or other methods. The tabs 112 may be fractured or removed at the drilling site or prior to transfer to the drill site, or the sleeve could be manufactured with a reduced number of tabs in the beginning. The ability to fracture or remove the tabs 112, or to choose from a variety of sleeves manufactured with different amounts of tabs, allows a user to adjust the elasticity of the tubular sleeve 100, and thus the associated sponge liner, to tailor the elasticity of the sponge liner to a particular formation to be cored. For example, prior to coring a formation, a user may remove as many of the tabs as necessary to provide the sleeve 100 with a desired degree of enhanced elasticity in consideration of the parameters of a formation to be cored. To achieve a maximum elasticity of a particular sponge liner of the present disclosure, a user may remove or fracture all of the tabs associated with each of the slots 102. In this manner, as a core 18 moves upward within the sponge liner as the coring tool progresses downward into the formation, an annular sponge layer attached to the inner surface 108 of the sleeve 100 may remain in contact with the core 18 while also exerting a decreased amount of friction on the core 18 by virtue of the elasticity of the sleeve 100 provided by the arrangement of the slots 102 and tabs 112 therein. Moreover, the increased elasticity of the sleeve 100, configured as disclosed herein, allows one or both of the sleeve and the sponge layer to have an inner diameter smaller than that of a sponge layer of a prior art sponge liner without a corresponding increased risk of damage to the core 18 caused as a result of friction between the core 18 and the sponge layer. It is to be appreciated that the elasticity of the sleeve 100 may also be increased by forming the sleeve 100 to have a fewer number of tabs 112 interposed between slot segments.

The slots 102 and tabs 112 of the sleeve 100 may be configured such that removing or fracturing some or all of the tabs 112 to increase the radial elasticity of the sleeve 100 substantially does not affect the elasticity or rigidity of the sleeve 100 in the longitudinal direction. In this manner, a user may remove or fracture certain tabs 112 to provide the sleeve 100 with a desired degree of radial elasticity (to accommodate a certain formation to be cored) while not affecting the longitudinal elasticity of the sleeve 100, and thus not compromising the rigidity of the sleeve 100 in the longitudinal direction.

Figure 4:
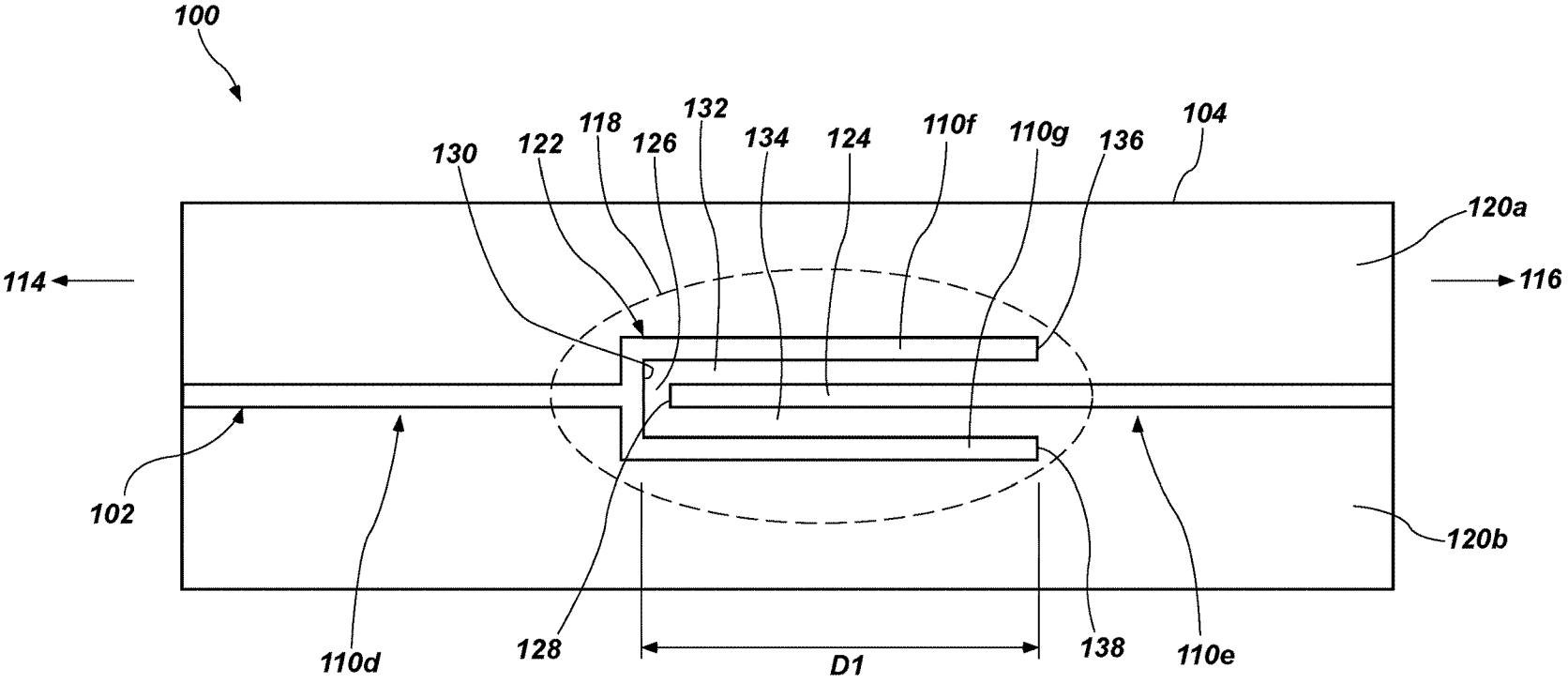
FIG. 4 illustrates a plan view of a portion of a tubular sleeve of the sponge liner, the tubular sleeve having a link arrangement formed in a wall thereof, according to an embodiment of the present disclosure.
Figure 4A:
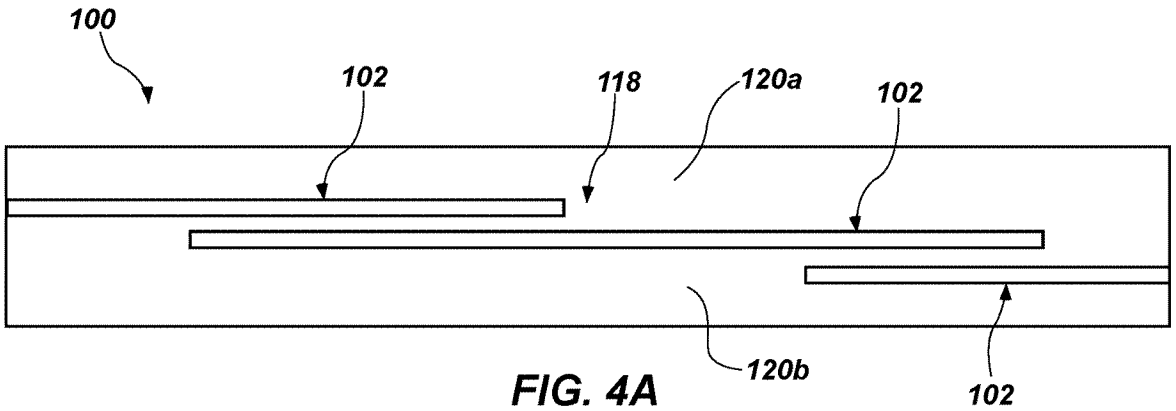
FIGS. 4A through 4D illustrate plan views of additional link arrangements formed in the wall of a tubular sleeve, according to additional embodiments of the present disclosure.
Figure 4B:
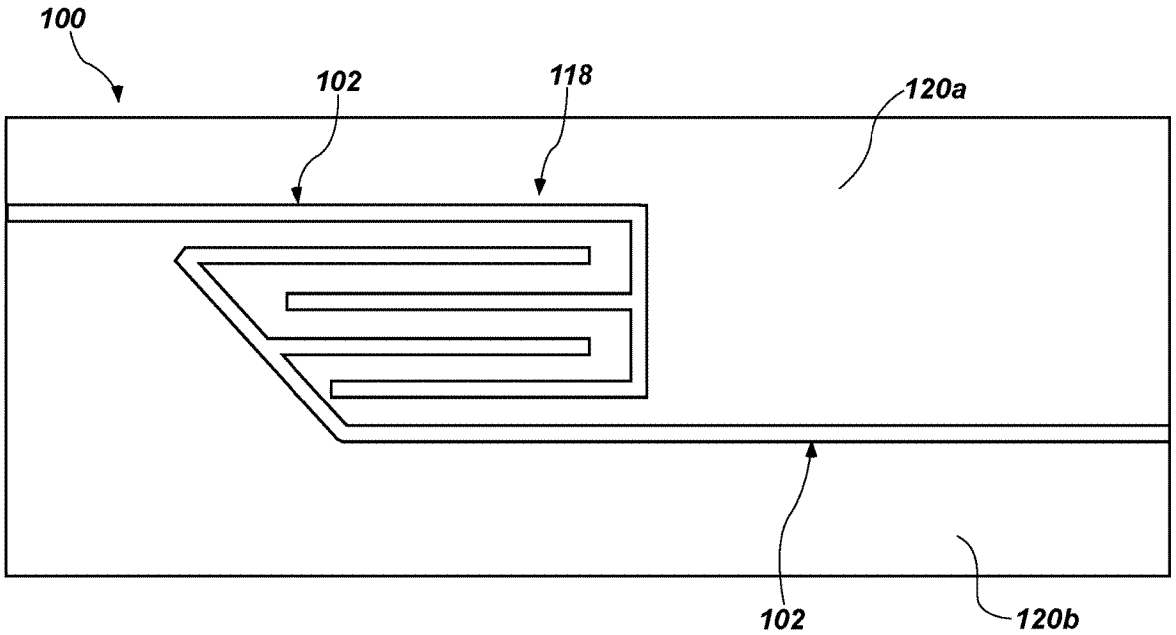
Figure 4C:
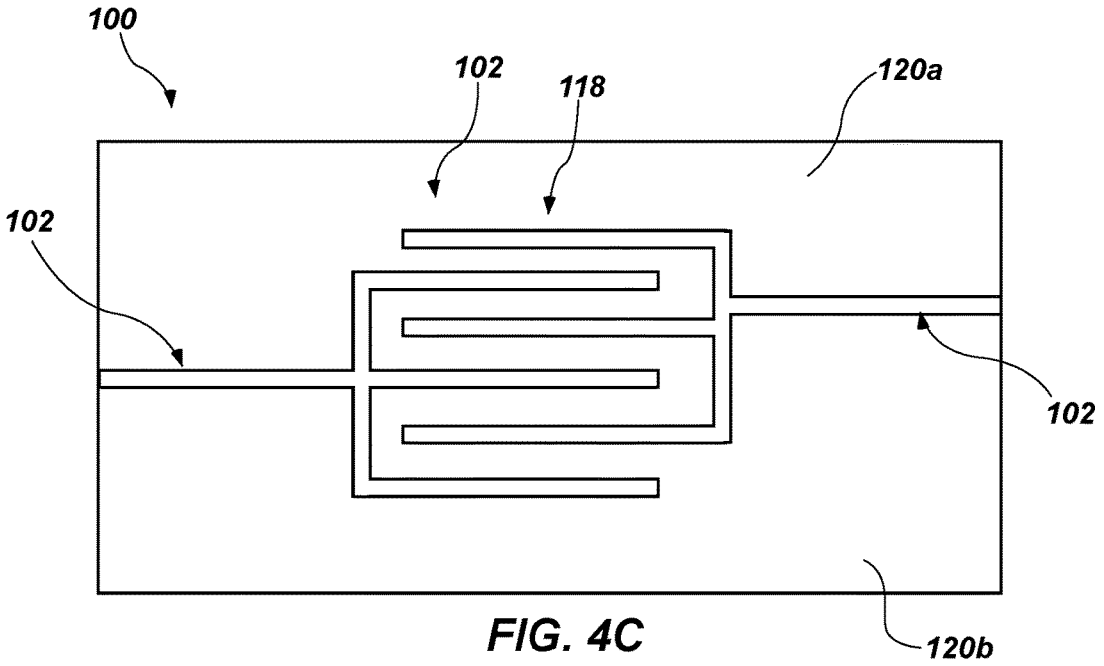
Figure 4D:
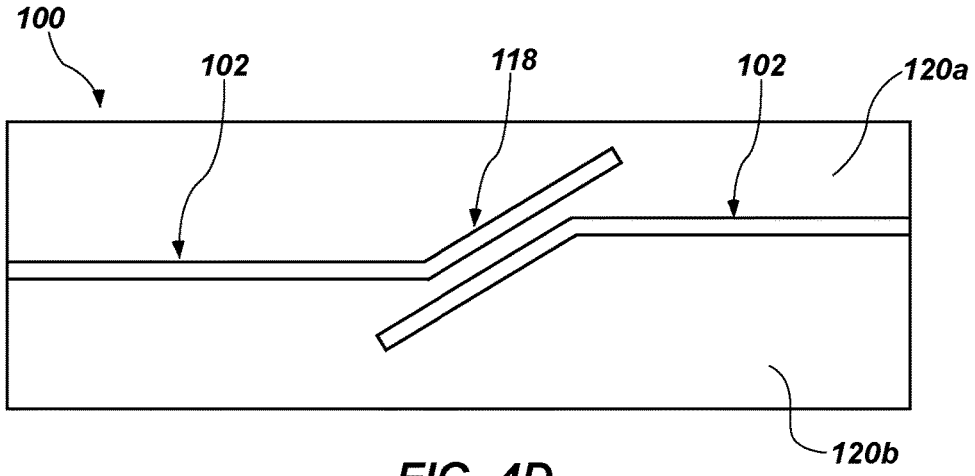

In other embodiments, increased radial elasticity of the sleeve 100 may be provided by one or more link arrangements formed in the sleeve 100. FIG. 4 illustrates a view of a single link arrangement 118 formed in the sleeve 100, however, it is to be appreciated that each slot 102 of the sleeve 100 may include a plurality of link arrangements 118 interposed between slot segments 110, similarly as described above in relation to the tabs 112 shown in FIG. 3. As shown in FIG. 4, a slot 102 may extend longitudinally through the wall 104 of the sleeve 100 in a direction from the upper end 114 of the sleeve 100 to the lower end 116 of the sleeve 100, substantially separating a first circumferential section 120*a* of the sleeve 100 from a second circumferential section 120*b* of the sleeve 100 located on opposite circumferential sides of the slot 102. The link arrangement 118 may connect the first circumferential section 120*a* and the second circumferential section 120*b* of the sleeve 100.

The slot 102 may include at least two (2) segments, such as an upper segment 110*d* and a lower segment 110*e*, separated from one another by a material link of the wall 104 of the sleeve 100. A forked lower portion 122 of the upper slot segment 110*d* may branch out and include slot branches 110*f*, 110*g* extending parallel with, and on either circumferential side of, an upper end portion 124 of the lower slot segment 110*e*, wherein the slot branches 110*f*, 110*g* provide a degree of longitudinal overlap between the lower portion 122 of the upper slot segment 110*d* and the upper portion 124 of the lower slot segment 110*e*. The link arrangement 118 may include a portion of material of the sleeve wall 104 extending circumferentially and longitudinally between the forked lower portion 122 of the upper slot segment 110*d* and the upper portion 124 of the lower slot segment 110*e*. For example, as shown in FIG. 4, the link arrangement 118 may include a wall portion 126 extending longitudinally between an upper end 128 of the lower slot segment 110*e* and a lower base portion 130 of the forked lower portion 122 of the upper slot segment 110*d*. The link arrangement 118 may also include a first longitudinal wall portion 132 extending parallel with and circumferentially between the upper portion 124 of the lower slot segment 110*e* and one of the slot branches 110*f* of the forked lower portion 122 of the upper slot segment 110*d* on a first circumferential side of the lower slot segment 110*e*. The link arrangement 118 may also include a second longitudinal wall portion 134 extending parallel with and circumferentially between the upper portion 124 of the lower slot segment 110*e* and the other of the branches 110*g* of the forked lower portion 122 of the upper slot segment 110*d* on a second circumferential side of the lower slot segment 110*e* opposite the first circumferential side. Each of the first and second longitudinal wall portions 132, 134 of the link arrangement 118 may extend a length $D_1$ from the lower base portion 130 of the upper slot segment 110*d* to the lower end 136, 138 of an associated branch portion 110*f*, 110*g* of the forked lower portion 122 of the upper slot segment 110*d*. While FIG. 4 illustrates that each of the first and second longitudinal wall portions 132, 134 of the link arrangement 118 have the same length $D_1$, it is to be appreciated that the first and second longitudinal wall portions 132, 134 of the link arrangement 118 may have differing lengths, as determined by the longitudinal lengths of the slot branches 110*f*, 110*g*.

The length $D_1$ and circumferential width of each of the first and second longitudinal wall portions 132, 134, as well as the circumferential width of the slot segments 110*d*, 110*e*, including the slot branches 110*f*, 110*g* of the upper slot segment 110*d*, may each be sized and configured to provide the sleeve 100 with a predetermined degree of radial elasticity. It is to be appreciated that the link arrangement of FIG. 4 embodies one possible link arrangement 118 design, while other link arrangement designs are also within the scope of the present disclosure. Other non-limiting examples of link arrangements are shown in FIGS. 4A through 4D, which may include fewer than or more than two longitudinal wall portions, similar to the wall portions 132, 134 shown in FIG. 4. Additionally, the wall portions 132 of FIGS. 4A through 4D may vary in length $D_1$, orientation and shape from those shown in FIG. 4.

Additionally, it is also to be appreciated that link arrangements, such as the link arrangement 118 of FIG. 4, may be used in combination with the tabs 112 described in reference to FIG. 3 to provide the sleeve 100 with an overall adjustable radial elasticity. Moreover, the radial elasticity of the sleeve 100 may be further increased by removing or fracturing portions of the link arrangements 118.

Figure 5:
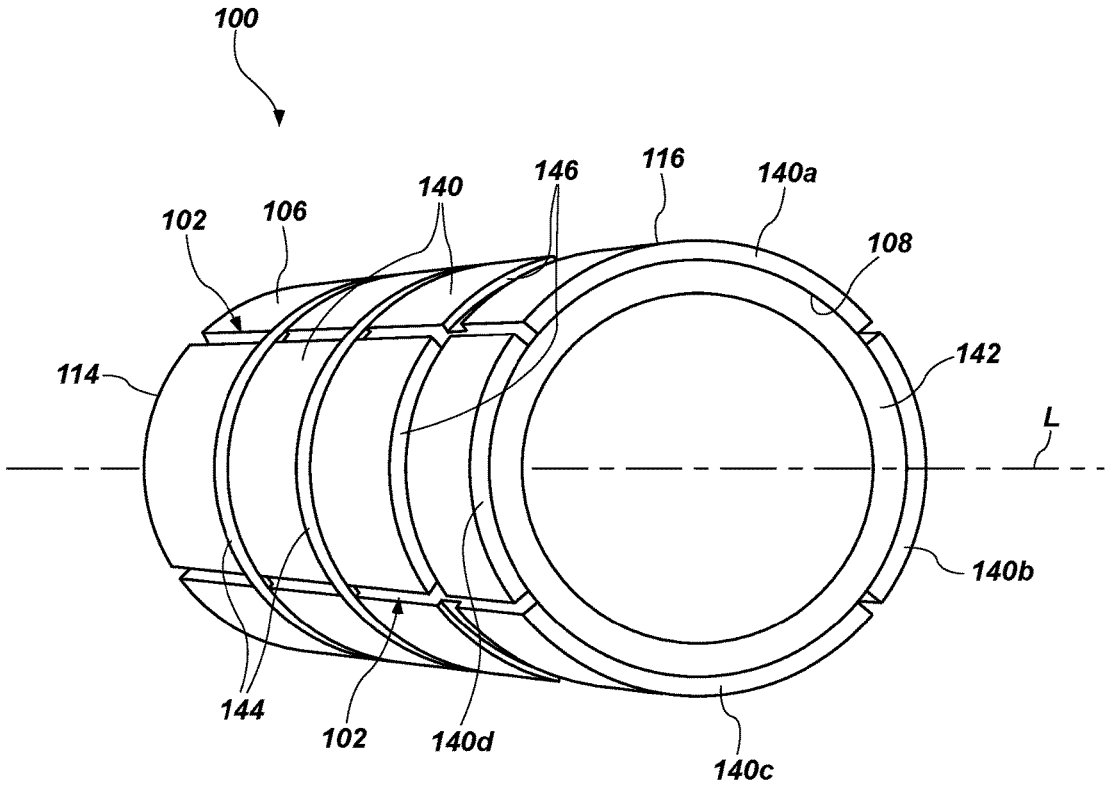
FIG. 5 illustrates a perspective view of tubular sleeve of a sponge liner, the sleeve having slots extending continuously from an upper end to a lower end of the sleeve, according to an embodiment of the present disclosure.
Figure 6A:
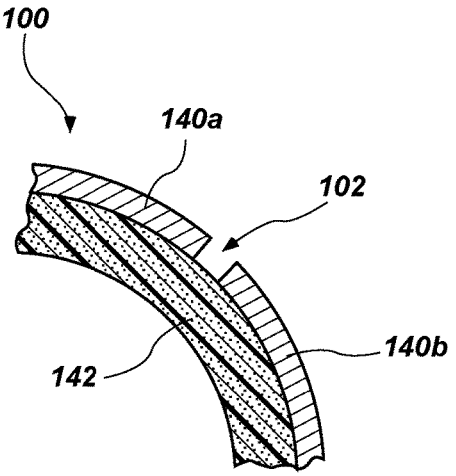
FIG. 6A illustrates a partial transverse cross-sectional view of a sponge liner having a sleeve and a sponge layer attached therein, wherein the sponge layer does not extend within a slot formed in the sleeve, according to an embodiment of the present disclosure.
Figure 6:
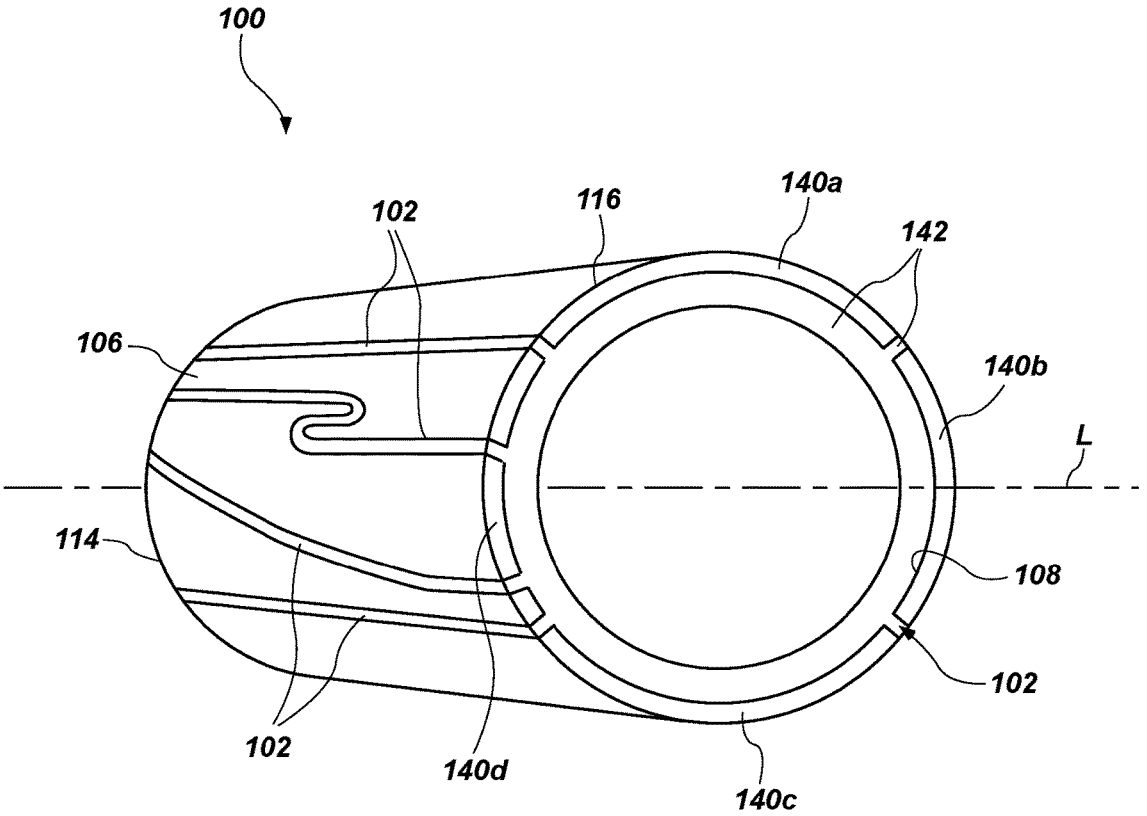
FIG. 6 illustrates a perspective view of tubular sleeve of a sponge liner, the sleeve having slots extending continuously from an upper end to a lower end of the sleeve, a sponge liner disposed within the sleeve and having portions located within the slots, according to an embodiment of the present disclosure.

FIG. 5 illustrates an embodiment of the sleeve 100 separated into four (4) circumferential sections 140 separated by four (4) slots 102 formed through the wall 104 of the sleeve 100 and extending from the upper end 114 of the sleeve 100 to the lower end 116 of the sleeve 100. Accordingly, each circumferential sleeve section 140 includes a portion of each of the upper and lower ends 114, 116 of the sleeve 100 and extends substantially continuously from the upper end 114 to the lower end 116 of the sleeve 100. In such an embodiment, the tubular sleeve 100 is not a single integral sleeve, but comprises separate, mutually adjacent circumferential sleeve sections 140. The slots 102 may be substantially parallel to the sleeve axis, as shown in FIG. 5, or may follow any direction along the length of the sleeve, as shown in FIG. 6. With continued reference to FIG. 5, the sleeve 100 may include a first sleeve section 140*a*, a second sleeve section 140*b*, a third sleeve section 140*c*, and a fourth sleeve section 140*d*. An annular sponge layer 142 may be attached to the inner surface of each of the sleeve sections 140*a*, 140*b*, 140*c*, 140*d* by an adhesive or other attachment means. While FIG. 5 illustrates the tubular sleeve 100 formed of four (4) sleeve sections 140*a*, 140*b*, 140*c*, 140*d*, it is to be appreciated that the sleeve 100 may comprise fewer or more than four (4) sleeve sections. For example, the sleeve 100 may include as few as two (2) sleeve sections 140. In other embodiments, the sleeve 100 may include five (5) sleeve sections 140. In further embodiments, the sleeve 100 may include eight (8) or more sleeve sections 140. The present disclosure does not contemplate an upper limit to the amount of sleeve sections 140 forming the tubular sleeve 100 of the sponge liner.

With continued reference to FIG. 5, in addition to having the sponge layer 142 attached to an inner surface 108 thereof, the sleeve sections 140 may be further coupled together by a plurality of external wire springs 144 extending circumferentially around the sleeve 100. The external wire springs 144 may be located within and extend through circumferential grooves or channels 146 formed in the outer surface 106 of the sleeve sections 140. While the sleeve 100 shown in FIG. 5 is configured to include three (3) external wire springs 144 extending circumferentially around the sleeve 100 to further couple the sleeve sections 140 together, only two (2) of the external wire springs 144 are shown, while a circumferential channel 146 having no external wire spring 144 therein is shown for illustrative purposes. It is to be appreciated that the sleeve 100 of FIG. 5 may be configured to accommodate more or less than three (3) external wire springs 144. For example, in some embodiments, a sleeve 100, such as the one shown in FIG. 5, may have as few as one circumferential channel 146 formed in the outer surfaces 106 of the sleeve sections 140 for housing a single external wire spring 144. In other embodiments, the sleeve 100 may have five (5) circumferential channels 146 formed in the outer surfaces 106 of the sleeve sections 140 for housing five (5) external wire springs 144. In further embodiments, the sleeve 100 may have eight (8) circumferential channels 146 formed in the outer surfaces 106 of the sleeve sections 140 for housing eight (8) external wire springs 144. In yet other embodiments, the sleeve 100 may have ten (10) or more circumferential channels 146 formed in the outer surfaces 106 of each of the sleeve sections 140 for housing ten (10) or more external wire springs 144. Of course, springs of other materials and shape, such as elastomeric springs or rings, may also be employed. In other embodiments, other elastic elements could be used to couple the sleeve sections 140. For example, such elastic elements may comprise one or more of a mesh, a fabric, a hose, or other elastic structures.

It is also to be appreciated that the sleeve sections 140 may be coupled together by other fastening devices, including clamps, screws, bolts, or other mechanical fasteners. Such mechanical fasteners may be fractured or uncoupled, in a similar manner as previously described, prior to a coring run to provide the sleeve 100 with greater elasticity if so desired. In other embodiments, the sleeve sections 140 may be coupled by an elastic material, such as a silicone or other polymer, located in the slots between adjacent sleeve sections 140 and adhering to side walls of the adjacent sleeve sections 140 in a manner to elastically bond the sleeve sections 140 together. Other fastening means for elastically coupling the sleeve sections 140 together are also within the scope of the present disclosure.

In other embodiments, as shown in FIG. 6, the sponge layer 142 may be formed to extend radially outwardly into and within the slots 102 and to adhere to side walls of adjacent sleeve sections 140 as well as to inner surfaces of the sleeve sections 140. In this manner, each of the sleeve sections 140 may be coupled to the sponge layer 142 at the inner surfaces 108 and side walls of each of the sleeve sections. In such embodiments, the overall integrity of the sleeve 100 may be maintained by the sleeve sections 140 and the sponge layer 142 without the need for any additional fastening mechanism or means for coupling the sleeve sections 140 together. In yet other embodiments, as shown in FIG. 6A, the sponge layer 142 may not extend into and within the slots 102 or adhere to the side walls of the sleeve sections 140. In such embodiments, the sponge layer 142 links the sleeve sections 140 together. In other embodiments, the sponge layer 142 may extend partially into and within the slots 102 and may adhere to portions of the side walls of the sleeve sections 140 to which the sponge layer 142 is in contact. The increased circumferential elasticity in embodiments as described in this paragraph may result from the elasticity of the sponge material coupling the sleeve sections 140.

Figure 7:
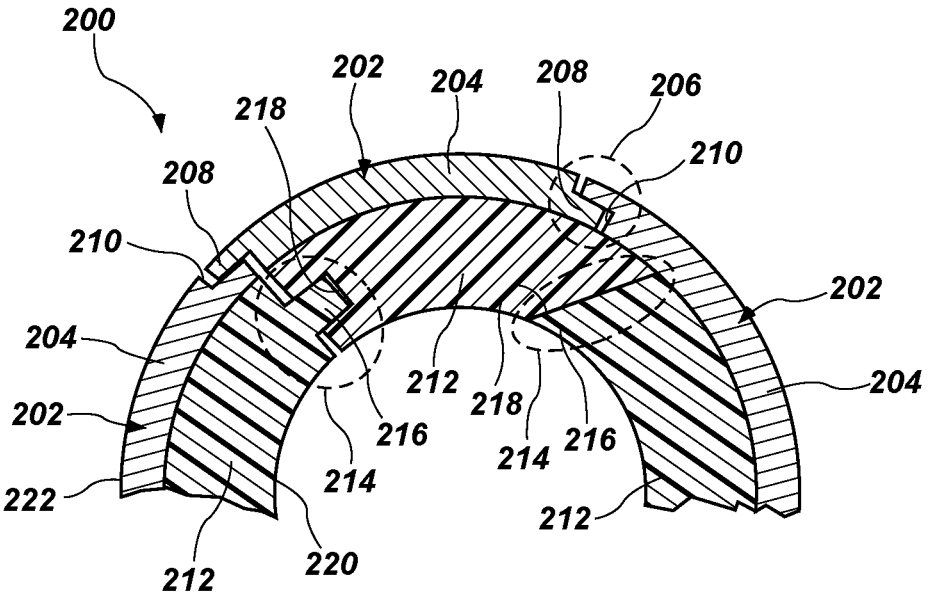
FIG. 7 illustrates a partial transverse cross-sectional view of a sponge liner, according to an embodiment of the present disclosure.
Figure 8:
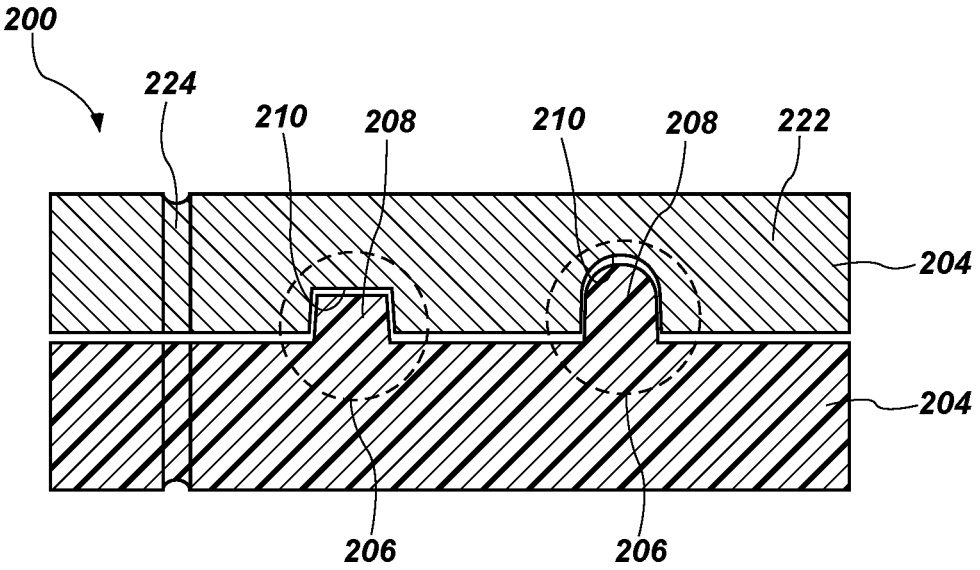
FIG. 8 illustrates a partial longitudinal plan view of a sponge liner, according to an embodiment of the present disclosure.

In other embodiments, as shown in FIG. 7 and FIG. 8, a liner 200 may be constructed of a multitude of individual segments 202, which are combined to cover a substantially full circumference. Individual liner sleeve segments 204 may have overlapping areas 206 in a circumferential direction, to maintain a substantially cylindrical outer shape of the liner 200, while allowing a change in the circumference. For example, the individual liner sleeve segments 204 may each have a protrusion 208 extending within a recess 210 of an adjacent liner sleeve segment 204 to form the overlapping areas 206. These overlapping areas 206 may extend in a longitudinal direction over only a portion or over the entirety of the longitudinal length of the liner 200. For example, as shown in FIG. 8, the protrusions 208 and associated recesses 210 of the liner sleeve segments 204 may be located at distinct longitudinal positions of the liner 200 and may be squared, rounded, or shaped according to any of various other shapes. Portions of the overlapping areas 206 may be configured to substantially maintain the liner sleeve segments 204 mutually at the same longitudinal location. Additionally, the protrusions 208 may transmit forces to the recesses 210 in a direction substantially parallel to the longitudinal axis L of the liner 200. Referring again to FIG. 7, associated absorptive layers 212 of the liner segments 202 may also have areas 214 overlapping in a circumferential direction. For example, the absorptive layer segments 212 may each have a protrusion 216 extending within a recess 218 of an adjacent absorptive layer segment 212. As with the liner sleeve segments 204 shown in FIG. 8, the protrusions 216 and associated recesses 218 of the absorptive layer segments 212 may be located at distinct longitudinal positions of the liner 200 and may have various shapes and configurations. These overlapping areas 206 and 214 of the liner sleeve segments 204 and the absorptive layer segments 212 may ensure that there is no open fluid passage from an inner surface 220 of the liner 200 towards an outer periphery 222 of the liner 200, where the formation fluid of interest may become lost for further analysis. Additionally, the protrusions 216 may transmit forces to the recesses 218 in a direction substantially parallel to the longitudinal axis L of the liner 200. As shown in FIG. 8, the individual liner segments 202 may be held together by elastic elements (not shown) located in circumferential grooves 224 formed in the outer periphery 214 of the liner sleeve segments 204, as previously described, by way of non-limiting example.

Additional non-limiting example embodiments of the present disclosure are set forth below.

Embodiment 1

A liner for a core barrel assembly, comprising: a sleeve having an inner surface configured to be coupled to a layer of material configured to absorb or adsorb formation fluids or parts of formation fluids, wherein, at every longitudinal location of the sleeve, a transverse cross-section of a wall of the sleeve includes at least one gap extending radially through the entire wall of the sleeve, and the sleeve having a flexibility in a circumferential direction greater than that of a sleeve without a gap extending radially through a wall of the sleeve at a transverse cross-section of the sleeve at every longitudinal location of the sleeve.

Embodiment 2

The liner of Embodiment 1, wherein the at least one gap in the transverse cross-section corresponds to at least one slot formed in the sleeve, the at least one slot extending radially through a wall of the sleeve, at least a portion of the at least one slot extending longitudinally along at least a portion of a length of the sleeve, and one or more material links of the wall of the sleeve separating segments of the at least one slot or separating one of the at least one slot from another of the at least one slot.

Embodiment 3

The liner of Embodiment 2, wherein the at least one slot includes at least a first slot segment and a second slot segment, the first slot segment having a portion circumferentially offset from and longitudinally coextensive with a portion of the second slot segment, a portion of the wall of the sleeve located circumferentially between and longitudinally coextensive with the portion of the first slot segment and the portion of the second slot segment.

Embodiment 4

The liner of Embodiment 3, wherein the first slot segment and the second slot segment are circumferentially symmetrically located about a circumference of the sleeve.

Embodiment 5

The liner of Embodiment 2, further comprising the layer of material coupled to an inner surface of the sleeve.

Embodiment 6

The liner of Embodiment 5, wherein the layer of material has a portion extending radially outward into and at least partially within the at least one slot.

Embodiment 7

The liner of Embodiment 1, wherein the at least one gap in the transverse cross-section corresponds to at least one slot formed in the sleeve, the at least one slot extending radially through a wall of the sleeve, at least a portion of the at least one slot extending longitudinally along an entire length of the sleeve.

Embodiment 8

The liner of Embodiment 1, wherein the at least one gap in the transverse cross-section corresponds to at least one slot formed in the sleeve, the at least one slot extending radially through a wall of the sleeve, at least a portion of the at least one slot extending longitudinally along at least a portion of a length of the sleeve, the at least one slot comprising three or more slots circumferentially separated from one another about a circumference of the sleeve.

Embodiment 9

A liner for a core barrel assembly, comprising: a sleeve having at least two circumferential segments each having an inner surface coupled to a layer of material, the layer of material configured to absorb or adsorb formation fluids or portions thereof, wherein the at least two circumferential segments of the sleeve are separated from one another by slots formed through a wall of the sleeve; and an elastic element in contact with the at least two circumferential segments of the sleeve, the elastic element extending in a circumferential direction.

Embodiment 10

The liner of Embodiment 9, wherein the elastic element is substantially ring shaped, the elastic element comprises one or more of a metal, a metal alloy, and an elastomeric material, and the elastic element configured to exert a force on the at least two circumferential segments of the sleeve in a substantially circumferential direction about the longitudinal axis of the liner.

Embodiment 11

The liner of Embodiment 9, wherein the elastic element comprises the layer of material configured to absorb or adsorb formation fluids or portions thereof.

Embodiment 12

The liner of Embodiment 9, wherein the elastic element comprises one or more of a mesh, a fabric, and a hose, the elastic element extending around at least a portion of a circumference of the liner, and the elastic element coupled to one or more of the layer of material and the at least two circumferential segments of the sleeve.

Embodiment 13

The liner of Embodiment 9, further comprising at least one protrusion on one of the at least two circumferential segments of the sleeve, the at least one protrusion extending within at least one recess on another of the at least two circumferential segments of the sleeve, the at least one protrusion configured to transmit forces to the at least one recess in a direction substantially parallel to the longitudinal axis of the liner.

Embodiment 14

A liner for a core barrel assembly, comprising: at least two separate liner segments together extending around a circumference of the liner, wherein at least one of the at least two separate liner segments is coupled to an associated layer of material, the associated layer of material configured to absorb or adsorb formation fluids or portions thereof; and at least one elastic element located on an outer surface of the at least two separate liner segments, the at least one elastic element configured to act as a spring member.

Embodiment 15

The liner of Embodiment 14, further comprising: at least one protrusion on one of the at least two separate liner segments of the sleeve; at least one recess on another of the at least two separate liner segments of the sleeve, the at least one protrusion configured to transmit forces to the at least one recess in a direction substantially parallel to the longitudinal axis of the liner.

Embodiment 16

The liner of Embodiment 14, wherein a portion of one of the associated layers of material overlaps with a portion of another of the associated layers of material in a substantially circumferential direction.

Embodiment 17

A method of forming a liner for a core barrel assembly, the method comprising: providing a sleeve, the sleeve having an inner surface configured to be coupled to a layer of material configured to absorb or adsorb formation fluids or parts of formation fluids, wherein, at every longitudinal location of the sleeve, a transverse cross-section of a wall of the sleeve includes at least one gap extending radially through the entire wall of the sleeve, and the sleeve having a flexibility in a circumferential direction greater than that of a sleeve without a gap extending radially through a wall of the sleeve at a transverse cross-section of the sleeve at every longitudinal location of the sleeve.

Embodiment 18

A method of building a coring tool having a liner for a core barrel assembly, the method comprising: locating a sleeve in a core barrel assembly, the sleeve having an inner surface configured to be coupled to a layer of material configured to absorb or adsorb formation fluids or parts of formation fluids, wherein, at every longitudinal location of the sleeve, a transverse cross-section of a wall of the sleeve includes at least one gap extending radially through the entire wall of the sleeve, and the sleeve having a flexibility in a circumferential direction greater than that of a sleeve without a gap extending radially through a wall of the sleeve at a transverse cross-section of the sleeve at every longitudinal location of the sleeve.

Embodiment 19

A method of coring a formation of subterranean earth material, the method comprising: engaging a formation of subterranean earth material with a coring tool, the coring tool including a core barrel assembly having at least one liner disposed therein, the at least one liner including a layer of material coupled to an inner surface of a sleeve, the annular layer of material configured to absorb or adsorb formation fluids or parts of formation fluids; and modifying the circumferential flexibility of the at least one liner prior to a coring operation or during the course of a coring operation, wherein modifying the flexibility of the at least one liner comprises one or more of: adding or removing one or more spring members extending at least partially about a circumference of the sleeve; breaking one or more material links of a wall of the sleeve between adjacent slots formed in the wall of the sleeve; and generating at least one slot into the sleeve, the at least one slot extending radially through a wall of the sleeve, at least a portion of the at least one slot extending longitudinally along at least a portion of a length of the sleeve.

Embodiment 20

A method of coring a formation of subterranean earth material, the method comprising: engaging a formation of subterranean earth material with a coring tool, the coring tool including a core barrel assembly having at least one liner disposed therein, the at least one liner including a layer of material configured to absorb or adsorb formation fluids or parts of formation fluids coupled to an inner surface of a sleeve having an inner surface configured to be coupled to a layer of material; and expanding the sleeve radially as a core sample extends within the liner.

Embodiment 21

A liner for a core barrel assembly, comprising: a sleeve having an inner surface configured to be coupled to a layer of sponge material, the sleeve having at least one slot formed in an outer surface thereof, the at least one slot extending radially through a wall of the sleeve from an outer surface of the sleeve to the inner surface of the sleeve, at least a portion of the at least one slot extending longitudinally along at least a portion of the sleeve.

Embodiment 22

The liner of Embodiment 21, wherein the at least one slot comprises a plurality of slot segments, wherein a slot segment of the plurality of slot segments is separated from another slot segment of the plurality of slot segments by a material link.

Embodiment 23

The liner of Embodiment 22, wherein the material link comprises a tab of a wall of the sleeve, the tab sized and configured to be removed or fractured to join the slot segment with another slot segment.

Embodiment 24

The liner of Embodiment 23, wherein the plurality of slot segments comprises three slot segments, a first slot segment of the three slot segments located adjacent the first end of the sleeve, a second slot segment of the three slot segments located adjacent the second end of the sleeve, a third slot segment of the three slot segments located longitudinally between the first and second slot segments, a first tab of material located between the first end of the sleeve and the first slot segment, a second tab of material located between the first slot segment and the third slot segment, a third tab of material located between the third slot segment and the second slot segment, and a fourth tab of material located between the second slot segment and the second end of the sleeve.

Embodiment 25

The liner of Embodiment 22, wherein the at least one slot includes at least a first slot segment and a second slot segment, a first portion of the first slot segment located at a same circumference of the sleeve as a portion of the second slot segment, the first slot segment having a second portion circumferentially offset from and longitudinally coextensive with the portion of the second slot segment, a portion of the wall of the sleeve located circumferentially between and coextensive with each of the second portion of the first slot segment and the portion of the second slot segment.

Embodiment 26

The liner of Embodiment 21, wherein the at least one slot comprises three or more slots circumferentially separated from one another about a circumference of the sleeve.

Embodiment 27

The liner of Embodiment 21, where the at least one slot comprises six slots, located at intervals of about 60 degree about a circumference of the sleeve.

Embodiment 28

The liner of Embodiment 21, wherein the at least one slot extends continuously from the first end of the sleeve to the second end of the sleeve, the at least one slot separating the sleeve into at least two sleeve segments, each of the at least two sleeve segments extending longitudinally from the first end of the sleeve to the second end of the sleeve.

Embodiment 29

The liner of Embodiment 28, further comprising: at least one circumferentially extending channel formed in outer surfaces of the at least two sleeve segments; and a fastening element disposed in the at least one circumferentially extending channel, the fastening element coupling the at least two sleeve segments.

Embodiment 30

The liner of Embodiment 28, further comprising a layer of sponge material coupled to an inner surface of each of the at least two sleeve segments.

Embodiment 31

The liner of Embodiment 30, wherein the annular layer of sponge material has a portion extending outward into and at least partially within the at least one slot.

Embodiment 32

A liner for a core barrel assembly, comprising: a sleeve having at least one slot formed in an outer surface thereof, the at least one slot extending radially through a wall of the sleeve, at least a portion of the at least one slot extending longitudinally along the sleeve, the at least one slot configured to provide the sleeve with a degree of elasticity in a radial direction from a longitudinal axis of the sleeve; and an annular layer of sponge material coupled to an inner surface of the sleeve.

Embodiment 33

The liner of Embodiment 32, wherein the at least one slot comprises a plurality of slot segments, wherein a slot segment of the plurality of slot segments is separated from another slot segment of the plurality of slot segments by a material link.

Embodiment 34

The liner of Embodiment 33, wherein the material link comprises a tab of a wall of the sleeve, the tab sized and configured to be removed or fractured to join the slot segment with another slot segment.

Embodiment 35

The liner of Embodiment 32, wherein the at least one slot comprises three or more slots circumferentially separated from one another about a circumference of the sleeve.

Embodiment 36

The liner of Embodiment 32, wherein the at least one slot extends from the first end of the sleeve to the second end of the sleeve, the at least one slot separating the sleeve into at least two sleeve segments, each of the at least two sleeve segments extending longitudinally from the first end of the sleeve to the second end of the sleeve.

Embodiment 37

The liner of Embodiment 36, further comprising: at least one circumferentially extending channel formed in the outer surface of the at least two sleeve sections; and a fastening element disposed in the at least one circumferentially extending channel, the fastening element coupling the at least two sleeve segments.

Embodiment 38

A method of forming a liner for a core barrel assembly, the method comprising: providing a sleeve; forming at least one slot in an outer surface of the sleeve, the at least one slot extending radially through a wall of the sleeve, at least a portion of the at least one slot extending longitudinally along the sleeve, the at least one slot configured to provide the sleeve with a degree of elasticity in a radial direction from a longitudinal axis of the sleeve; and affixing a layer of sponge material to an inner surface of the sleeve.

Embodiment 39

The method of Embodiment 38, wherein forming the at least one slot comprises forming a plurality of slot segments in the outer surface of the sleeve, each of the plurality of slot segments extending from the outer surface of the sleeve radially inward through the inner surface of the sleeve, a slot segment of the plurality of slot segments being separated from another slot segment of the plurality of slot segments by a material link.

Embodiment 40

The method of Embodiment 39, further comprising fracturing or removing the material links between each of the plurality of slot segments.

Embodiment 41

A liner for a core barrel assembly, comprising a sleeve having an adjustable elasticity in the radial direction.

Embodiment 42

A method of coring a formation of subterranean earth material, the method comprising: engaging a formation of subterranean earth material with a coring tool, the coring tool including a core barrel assembly having at least one sponge liner disposed therein, the at least one sponge liner including an layer of sponge material coupled to an inner surface of a sleeve; and expanding the sleeve radially as a core sample extends within the sponge liner.

The embodiments of the disclosure described above do not limit the scope of the disclosure, which is defined by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those of ordinary skill in the art from the description. Such modifications and embodiments also fall within the scope of the appended claims.

What is claimed is:

1. A liner for a core barrel assembly, comprising:

a sleeve having an inner surface configured to be coupled to a layer of material configured to absorb or adsorb formation fluids or parts of formation fluids, wherein the sleeve includes a wall and at least one slot extending longitudinally along the sleeve and extending radially through the entire wall, wherein at least a portion of the at least one slot extends longitudinally along at least a portion of a length of the sleeve, and one or more material links of the wall of the sleeve separates segments of the at least one slot or separates one of the at least one slot from another of the at least one slot.

2. The liner of claim 1, wherein the at least one slot includes at least a first slot segment and a second slot segment, the first slot segment having a portion circumferentially offset from and longitudinally coextensive with a portion of the second slot segment, a portion of the wall of the sleeve located circumferentially between and longitudinally coextensive with the portion of the first slot segment and the portion of the second slot segment.

3. The liner of claim 2, wherein the first slot segment and the second slot segment are circumferentially symmetrically located about a circumference of the sleeve.

4. The liner of claim 1, further comprising a layer of material coupled to an inner surface of the sleeve.

5. The liner of claim 4, wherein the layer of material has a portion extending radially outward at least partially within the at least one slot.

6. The liner of claim 1, wherein at least a portion of the at least one slot extends longitudinally along an entire length of the sleeve.

7. The liner of claim 1, wherein at least a portion of the at least one slot extends longitudinally along at least a portion of a length of the sleeve, and the at least one slot comprises three or more slots circumferentially separated from one another about a circumference of the sleeve.

8. The liner of claim 1, wherein the layer of material comprises an elastic material.

9. A liner for a core barrel assembly, comprising:

a sleeve having at least two circumferential segments each having an inner surface coupled to a layer of material, the layer of material configured to absorb or adsorb formation fluids or portions thereof, wherein the at least two circumferential segments of the sleeve are separated from one another by slots formed through a wall of the sleeve;

an elastic element in contact with the at least two circumferential segments of the sleeve, the elastic element extending in a circumferential direction; and at least one protrusion on one of the at least two circumferential segments of the sleeve, the at least one protrusion extending within at least one recess on another of the at least two circumferential segments of the sleeve, the at least one protrusion configured to transmit forces to the at least one recess in a direction parallel to the longitudinal axis of the liner.

10. The liner of claim 9, wherein the elastic element is ring-shaped, the elastic element comprises one or more of a metal, a metal alloy, and an elastomeric material, and the elastic element configured to exert a force on the at least two circumferential segments of the sleeve in a circumferential direction about the longitudinal axis of the liner.

11. The liner of claim 9, wherein the elastic element comprises one or more of a mesh, a fabric, and a hose, the elastic element extending around at least a portion of a circumference of the liner, and the elastic element coupled to one or more of the layer of material and the at least two circumferential segments of the sleeve.

12. A liner for a core barrel assembly, comprising:

at least two separate liner segments together extending around a circumference of the liner, wherein at least one of the at least two separate liner segments is coupled to an associated layer of material, the associated layer of material configured to absorb or adsorb formation fluids or portions thereof; and at least one elastic element located on an outer surface of the at least two separate liner segments, the at least one elastic element configured to act as a spring member.

13. The liner of claim 12, further comprising:

at least one protrusion on one of the at least two separate liner segments of the sleeve;

at least one recess on another of the at least two separate liner segments of the sleeve, the at least one protrusion configured to transmit forces to the at least one recess in a direction parallel to the longitudinal axis of the liner.

14. The liner of claim 12, wherein the associated layer of material comprises a first layer of material and a second layer of material, wherein a portion of the first layer of material overlaps with a portion of the second layer of material in a circumferential direction.

15. A method of building a coring tool having a liner for a core barrel assembly, the method comprising:

locating a sleeve in a core barrel assembly, the sleeve having an inner surface, wherein the sleeve includes a wall and at least one slot extending longitudinally along the sleeve and extending radially through the entire wall, wherein at least a portion of the at least one slot extends longitudinally along at least a portion of a length of the sleeve, and one or more material links of the wall of the sleeve separates segments of the at least one slot or separates one of the at least one slot from another of the at least one slot and coupling a layer of material to the inner surface of the sleeve, the layer of material configured to absorb or adsorb formation fluids or parts of formation fluids.

16. A method of coring a formation of subterranean earth material, the method comprising:

engaging a formation of subterranean earth material with a coring tool, the coring tool including a core barrel assembly having at least one liner disposed therein, the at least one liner including a layer of material configured to absorb or adsorb formation fluids or parts of formation fluids coupled to an inner surface of a sleeve having an inner surface configured to be coupled to the layer of material, wherein the sleeve includes a wall and at least one slot extending longitudinally along the sleeve and extending radially through the entire wall;

expanding the sleeve radially as a core sample extends within the liner; and applying a radially inward force on the liner with a ring-shaped elastic element located on an outer surface of the sleeve.

17. A method of forming a liner for a core barrel assembly, the method comprising:

providing a sleeve;

forming at least one slot in an outer surface of the sleeve, the at least one slot extending radially through a wall of the sleeve, at least a portion of the at least one slot extending longitudinally along the sleeve, the at least one slot configured to provide the sleeve with a degree of elasticity in a radial direction from a longitudinal axis of the sleeve, wherein forming the at least one slot comprises forming a plurality of slot segments in the outer surface of the sleeve, each of the plurality of slot segments extending from the outer surface of the sleeve radially inward through an inner surface of the sleeve, a slot segment of the plurality of slot segments being separated from another slot segment of the plurality of slot segments by a material link; and affixing a layer of sponge material to the inner surface of the sleeve.

18. The method of claim 17, further comprising fracturing or removing the material links between each of the plurality of slot segments.

* * * * *